US012241247B2

(12) United States Patent
Høg

(10) Patent No.: US 12,241,247 B2
(45) Date of Patent: Mar. 4, 2025

(54) STEEL BEAM

(71) Applicant: PEIKKO GROUP OY, Lahti (FI)

(72) Inventor: Jonas Høg, Odense S (DK)

(73) Assignee: PEIKKO GROUP OY, Lahti (FI)

( * ) Notice: Subject to any disclaimer, the term of this patent is extended or adjusted under 35 U.S.C. 154(b) by 0 days.

(21) Appl. No.: 17/917,843

(22) PCT Filed: Apr. 14, 2021

(86) PCT No.: PCT/FI2021/050267
§ 371 (c)(1),
(2) Date: Oct. 7, 2022

(87) PCT Pub. No.: WO2021/214381
PCT Pub. Date: Oct. 28, 2021

(65) Prior Publication Data

US 2024/0384533 A1 Nov. 21, 2024

(30) Foreign Application Priority Data

Apr. 24, 2020 (FI) ..... 20205414

(51) Int. Cl.
*E04C 3/293* (2006.01)

(52) U.S. Cl.
CPC ..... *E04C 3/293* (2013.01)

(58) Field of Classification Search
CPC ..... E04B 1/185; E04B 1/215; E04B 1/383; E04B 1/30; E04B 2001/2427; E04B 2001/2409; E04C 3/293; E04C 3/294
See application file for complete search history.

(56) References Cited

U.S. PATENT DOCUMENTS 4,171,173 A * 10/1979 Hymans ..... F16B 9/05 403/189
2014/0318059 A1* 10/2014 Hansort ..... E04B 1/215 52/283

FOREIGN PATENT DOCUMENTS

| | | | | |
|---|---|---|---|---|
| CN | 110805203 A | 2/2020 | | |
| DE | 29711884 U1 | 12/1997 | | |
| KR | 101779449 B1 | 9/2017 | | |
| NL | 1020608 C2 | 11/2003 | | |
| NL | 2000955 C1 | 4/2009 | | |
| WO | 97/30235 A1 | 8/1997 | | |
| WO | WO-2004031498 A1 * | 4/2004 | ..... | E04B 1/215 |

OTHER PUBLICATIONS

Nov. 12, 2020 Search Report issued in Finnish Patent Application No. 20205414.
Jun. 23, 2021 Search Report issued in International Patent Application No. PCT/FI2021/050267.
Mar. 23, 2022 International Preliminary Report on Patentability issued in International Patent Application No. PCT/FI2021/050267.

* cited by examiner

*Primary Examiner* — Christine T Cajilig
(74) *Attorney, Agent, or Firm* — Oliff PLC

(57) ABSTRACT

A steel beam including a base plate, two web plates extending from the base plate, and an end plate of each end of the steel beam, wherein the base plate, the two web plates, the first end plates delimit a space configured to be filled at least partly with hardening material such as concrete. The steel beam includes a fill space at at least one of the ends of the steel beam. The fill space being limited by a fill space housing configured to separate the fill space from the space of the steel beam.

20 Claims, 18 Drawing Sheets

STEEL BEAM

FIELD

The invention relates to a steel beam as defined in the preamble of independent claim 1.

Steel beams to be filled with concrete to form steel-concrete-composite beams are normally on installation first supported on consoles arranged at a building component such as a column so that the console projects into a space of the steel beam via a console supporting slot provided at the end of the steel beam that is supported at the console and thereafter the space of the steel beam is filled i.e. casted with concrete so that the steel beam together with concrete will form a steel-concrete-composite beam. This casting will form a fire protection for the parts of the console in the space inside the steel beam and additionally protect parts such as bolts of the console inside the space of the steel beam from untightening. A problem with this is however that casted concrete will make the parts of the console inside the space of the steel beam inaccessible and this makes it impossible to dismount the steel-concrete-composite beam from the console without damaging the steel-concrete-composite beam.

OBJECTIVE

The object is to provide a steel beam that can be used to provide a steel-concrete-composite beam that provides for required fire protection of the parts of the console inside the steel beam and that is dismountable from a console of a building so that the steel-concrete-composite beam can be used as a building component at another location in the building or as a building component in another building.

SHORT DESCRIPTION

The steel beam of the invention is characterized by the definitions of independent claim 1.

Preferred embodiments of the steel beam are defined in the dependent claims.

LIST OF FIGURES

In the following the steel beam will described in more detail by referring to the figures, of which FIG. 1 shows a variant of a steel beam, FIG. 2 shows in top view an end of a steel beam according to a first embodiment, FIG. 3 shows the end of the steel beam according to the first embodiment shown in FIG. 2 as cut along line A-A in FIG. 2, FIG. 4 shows the end of the steel beam according to the first embodiment shown in FIG. 2 as cut along line B-B in FIG. 2, FIG. 5 shows the end of the steel beam according to the first embodiment shown in FIG. 2 as cut along line C-C in FIG. 2, FIG. 6 shows as cut along line D-D in FIG. 6 supporting a steel beam according to the first embodiment on a console provided at a column, FIG. 7 shows as cut along line E-E in FIG. 5 supporting a steel beam according to the first embodiment on a console provided at a column, FIG. 8 shows in top view an end of a steel beam according to a second embodiment, FIG. 9 shows the end of the steel beam according to the second embodiment shown in FIG. 8 as cut along line F-F in FIG. 8, FIG. 10 shows the end of the steel beam according to the second embodiment shown in FIG. 8 as cut along line G-G in FIG. 8, FIG. 11 shows the end of the steel beam according to the second embodiment shown in FIG. 8 as cut along line H-H in FIG. 8, FIG. 12 shows as cut along line I-I in FIG. 13 supporting a steel beam according to the second embodiment on a console provided at a column, FIG. 13 shows as cut along line J-J in FIG. 12 supporting a steel beam according to the second embodiment on a console provided at a column, FIG. 14 shows in top view an end of a steel beam according to a third embodiment, FIG. 15 shows the end of the steel beam according to the third embodiment shown in FIG. 7 as cut along line K-K in FIG. 14, FIG. 16 shows the end of the steel beam according to the third embodiment shown in FIG. 7 as cut along line L-L in FIG. 14, FIG. 17 shows as cut along line M-M in FIG. 18 supporting a steel beam according to the third embodiment on a console provided at a column, FIG. 18 shows as cut along line N-N in FIG. 17 supporting a steel beam according to the third embodiment on a console provided at a column, FIG. 19 shows in top view an end of a steel beam according to a fourth embodiment, FIG. 20 shows the end of the steel beam according to the fourth embodiment shown in FIG. 7 as cut along line O-O in FIG. 19, FIG. 21 shows the end of the steel beam according to the fourth embodiment shown in FIG. 7 as cut along line P-P in FIG. 19, FIG. 22 shows the end of the steel beam according to the fourth embodiment shown in FIG. 7 as cut along line Q-Q in FIG. 19, FIG. 23 shows as cut along line R-R in FIG. 24 supporting a steel beam according to the fourth embodiment on a console provided at a column, FIG. 24 shows as cut along line S-S in FIG. 23 supporting a steel beam according to the fourth embodiment on a console provided at a column, FIG. 25 shows in top view an end of a steel beam according to a fifth embodiment, FIG. 26 shows the end of the steel beam according to the fourth embodiment shown in FIG. 7 as cut along line T-T in FIG. 25.

DETAILED DESCRIPTION

Figure 1:
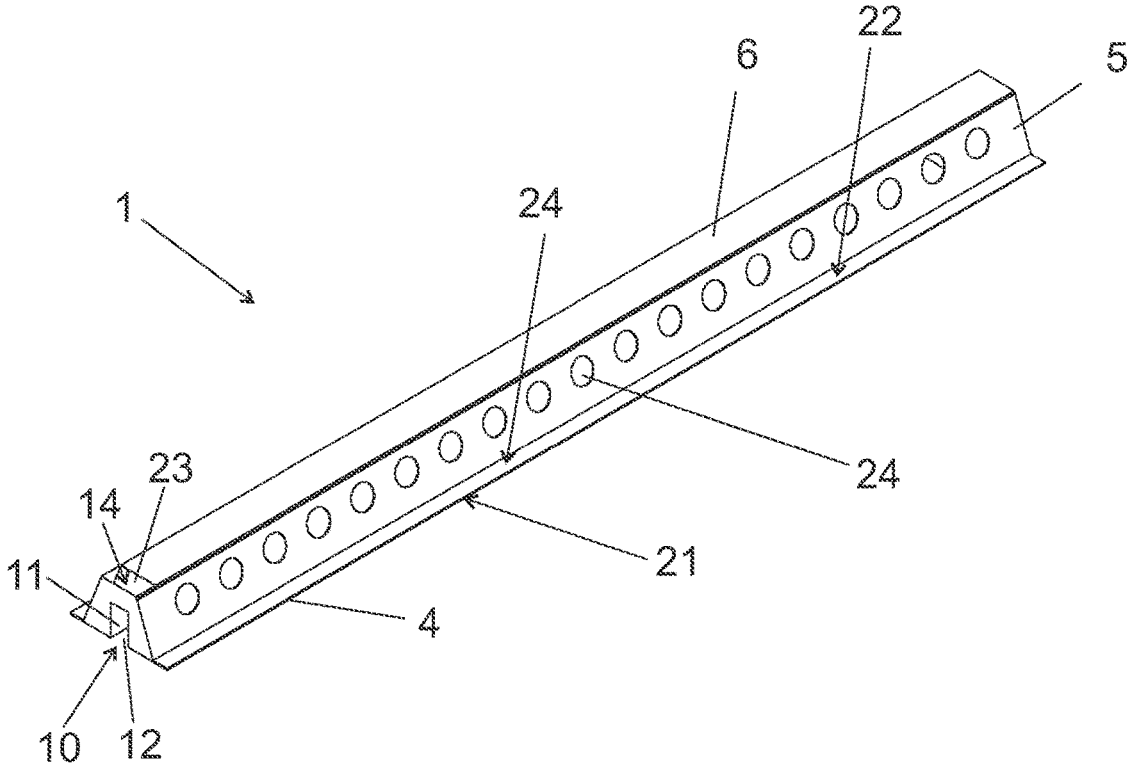
Figure 2:
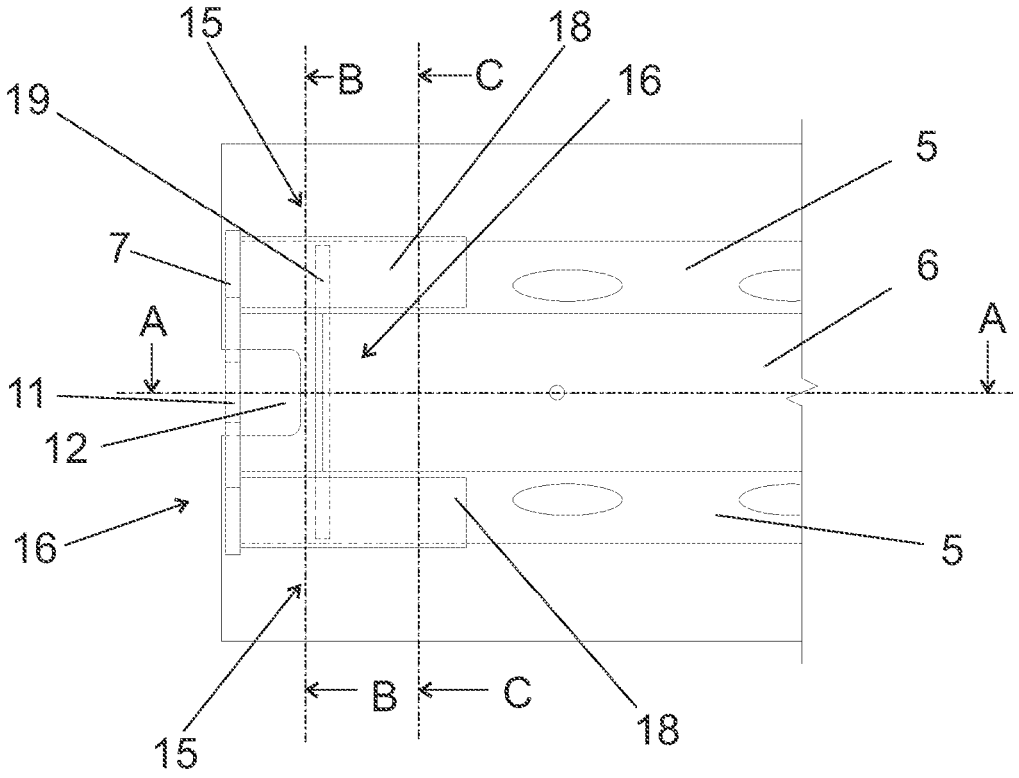
Figure 3:
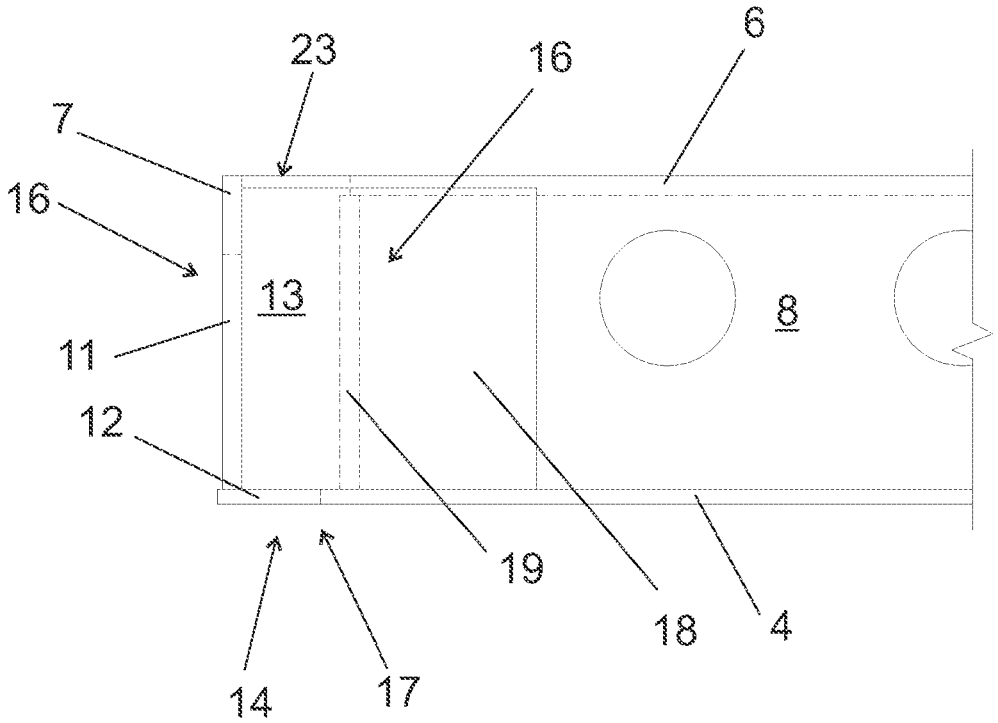
Figure 4:
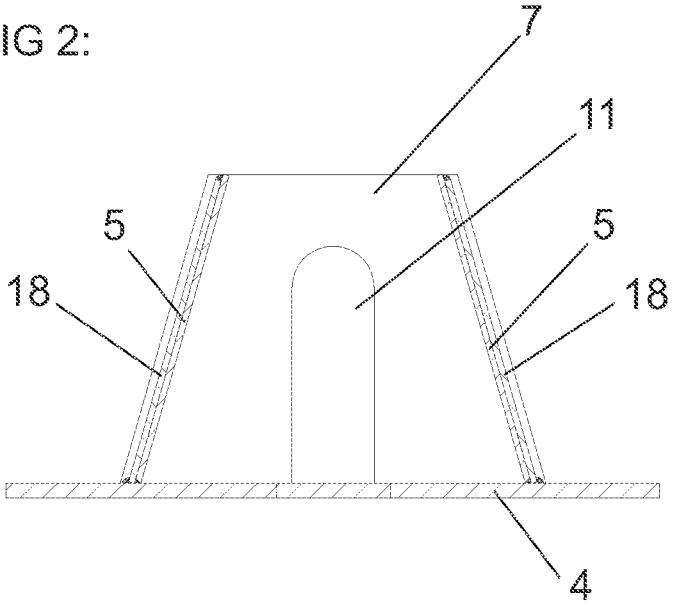
Figure 5:
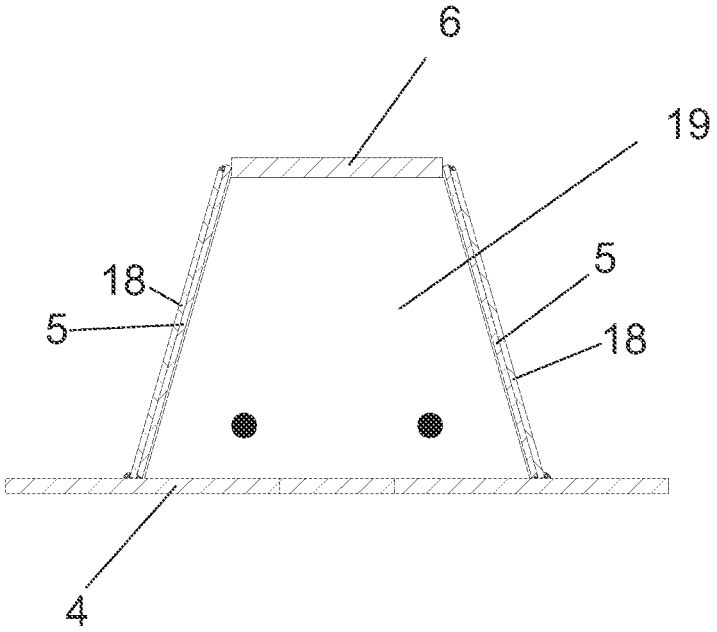

In the following some embodiments and variants of the steel beam 1 will be presented in greater detail.

The figures show some embodiments of the steel beam 1 and additionally supporting of some embodiments of the steel beam 1 on a console 2 provided at a column 3. The console 2 can alternatively be provided at another type of structure in a building other than at a column 3. The structure in the building can for example be a steel structure, a precast or a cast-in-situ concrete structure, or a steel-concrete-composite structure.

The steel beam 1 comprises a base plate 4, two web plates 5 extending from the base plate 4, optionally a top plate 6 connecting the two web plates 5, and an end plate 7 of each end of the steel beam 1. That the steel beam 1 comprises possible a top plate 6 means in this connection that the steel beam 1 can be a steel beam 1 comprising a top plate 6 as is the case in the steel beams 1 illustrated in the figures or alternatively that the steel beam 1 can be a steel beam 1 without a top plate so that the steel beam has an open top between the web plates 5.

The base plate 4, the two web plates 5, the possible top plate 6 and the end plates 7 delimit a space 8 configured to be filled at least partly with hardening material such as concrete 9.

At least one of the ends of the steel beam 1 comprising a console supporting slot 10 extending from said at least one end of the steel beam 1, wherein the console supporting slot 10 forms a first slot 11 in the end plate 7 of the steel beam 1 and a second slot 12 in the base plate 4 of the steel beam 1.

The steel beam 1 comprising a fill space 13 at at least one of the ends of the steel beam 1.

The fill space 13 being limited by a fill space housing 14 configured to separate the fill space 13 from the space 8 of the steel beam 1.

The console supporting slot 10 is provided at least partly in the fill space 13 so that the console supporting slot 10 is separated from the space 8 of the steel beam 1 by the fill space housing 14.

The fill space housing 14 has in addition to the supporting slot and possible air outlet openings leading out of the fill space a fill opening 23 leading into the fill space 13.

Provision of such fill space 13 that by means of the fill space housing 14 is separated from the space 8 of the steel beam 1 so that the console supporting slot 10 of the steel beam 1 is separated from the space 8 of the steel beam 1 by means of the fill space housing 14 makes it possible to fill the fill space 13 of the steel beam 1 around the console supporting slot 10 with a fill material that provides for required fire protection of the parts of the console with are inside the fill space 13 and that is easier to remove than the hardening material such as concrete 9 the space 8 of the steel beam 1 is filled with. This makes it possible to remove the steel beam 1 from a console 2 without damaging the steel beam 1 in such manner that the steel beam 1 can be reused in another location in the same building or be reused in another building. Lime mortar can for example be used as said fill material.

The fill space housing 14 comprises preferably, but not necessarily, at least two opposite side wall structures 15, at least two opposite end wall structures 16, and a bottom structure 17.

If the fill space housing 14 comprises at least two opposite side wall structures 15, at least two opposite end wall structures 16, and a bottom structure 17, the bottom structure 17 of the fill space housing 14 is preferably, but not necessarily, formed by the base plate 4 of the steel beam 1.

If the fill space housing 14 comprises at least two opposite side wall structures 15, at least two opposite end wall structures 16, and a bottom structure 17, one of the opposite end wall structures 16 of the fill space housing 14 is preferably, but not necessarily, formed by the end plate 7 of the steel beam 1 comprising the first slot 11.

In the first embodiment of the steel beam 1 illustrated in FIGS. 2 to 5, the fill space housing 14 comprises two opposite side wall structures 15, two opposite end wall structures 16, and a bottom structure 17.

In this first embodiment of the steel beam 1 the bottom structure 17 of the fill space housing 14 is formed by the base plate 4 of the steel beam 1.

In this first embodiment of the steel beam 1 one of the opposite end wall structures 16 of the fill space housing 14 is formed by the end plate 7 of the steel beam 1 comprising the first slot 11.

In this first embodiment of the steel beam 1 the opposite side wall structures 15 of the fill space housing 14 are formed by two additional web plates 18, each additional web plate 18 extending between one of the web plates 5. The additional web plates 18 provides also for additional strength of the steel beam 1 at the fill space housing 14.

In this first embodiment of the steel beam 1 the other of the opposite end wall structures 16 of the fill space housing 14 is formed by an additional end plate 19 that is provided separated from the end plate 7 of the steel beam 1 provided with the first slot 11 so that the additional end plate 19 extend between the top plate 6 of the steel beam 1, the base plate 4 of the steel beam 1, and the web plates 5 of the steel beam 1.

Figure 6:
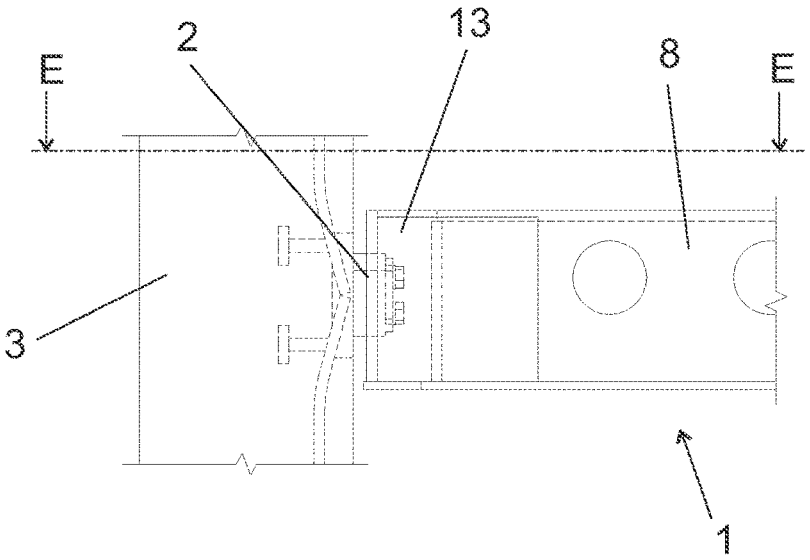
Figure 7:
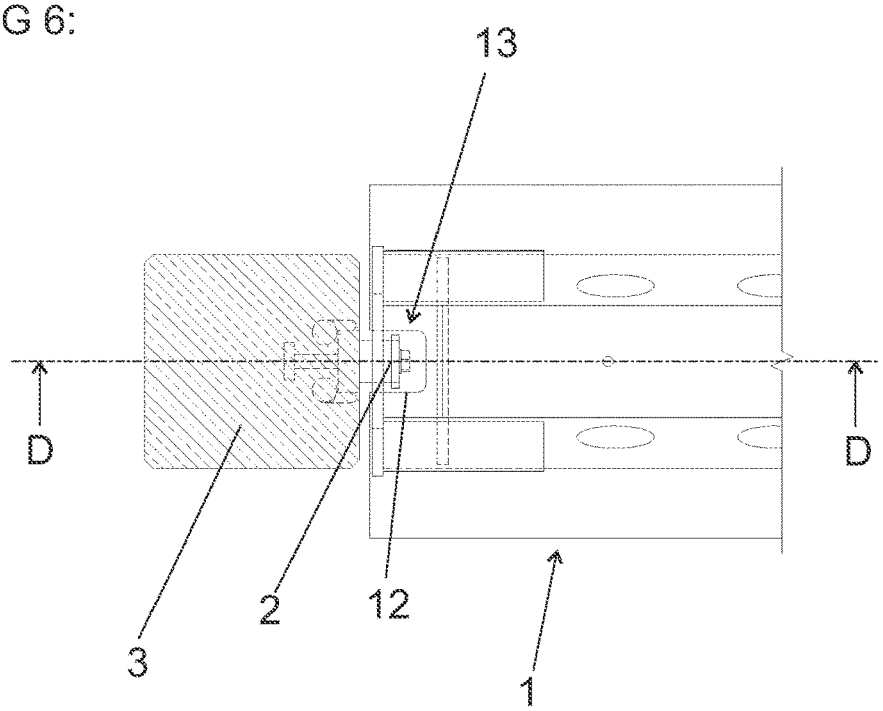
Figure 8:
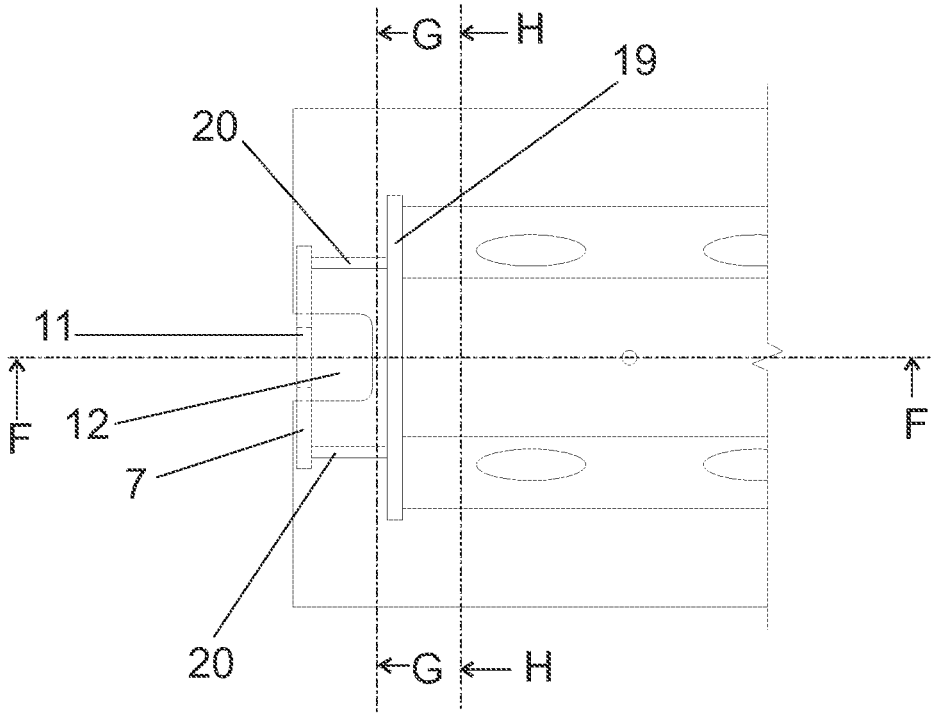
Figure 9:
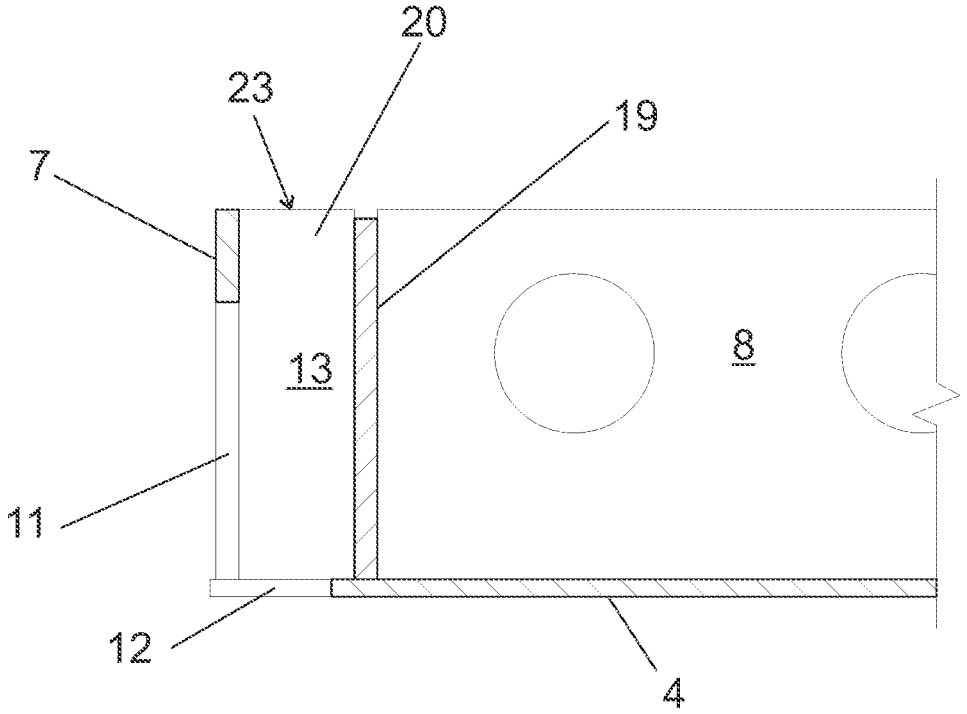
Figure 10:
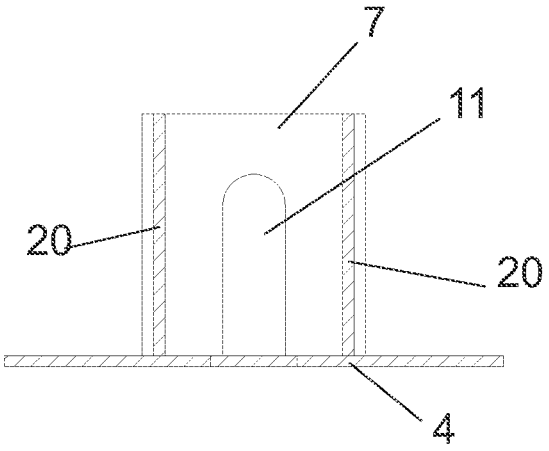
Figure 11:
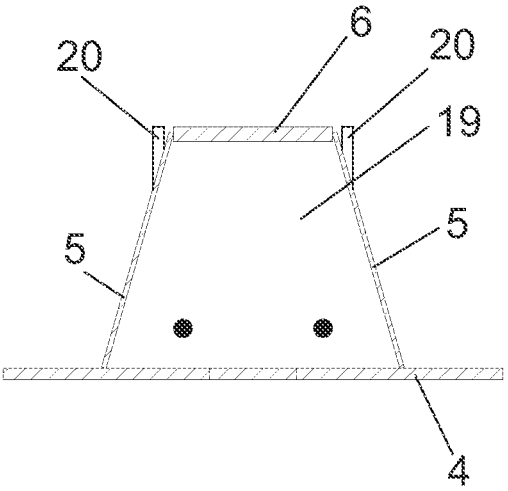
Figure 32:
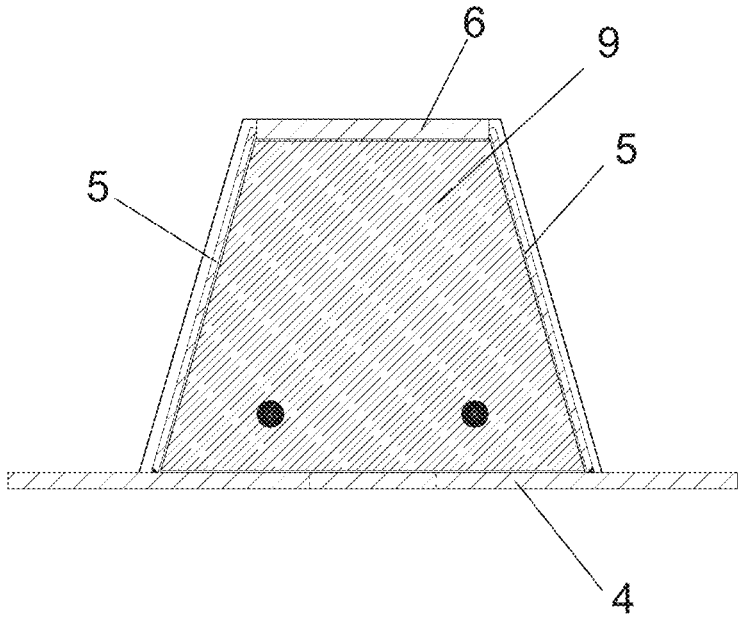
FIG. 32 shows a steel beam with an area filled at least partly with concrete.

FIGS. 6 and 7 shows supporting of the steel beam 1 according to the first embodiment on a console 2 provided at a column 3. As can be seen in FIGS. 6 and 7, the console 2 extends into the fill space 13 that is by means of the fill space housing 14 separated from the space 8 of the steel beam 1. Provision of the fill space housing 14 allows to fill the fill space 13 and the space 8 with different materials for example so that the fill space 13 is filled with a material that is easy to remove such as lime mortar, while the space 8 is filled with concrete, for example concrete 9 as shown in FIG. 32. To use easy to remove material in the fill space 13 promotes detaching of the steel beam 1 from the column 3 and makes it possible to remove the steel beam 1 from the console 2 without damaging the steel beam 1 in such manner that the steel beam 1 can be reused in another location in the same building or be reused in another building, because it will be easier to access the part of the console 2 that is in the fill space 13 and because the material in the fill space 13 can be removed so that it does not bind the steel beam 1 to the console 2. The material in the fill space 13 will provide for fire protection for a part of the steel beam 1 and the parts of console 2 inside the fill space and the material in the space 8 will provide for fire protection for other parts of the steel beam 1.

In the second embodiment of the steel beam 1 illustrated in FIGS. 8 to 11, the fill space housing 14 comprises two opposite side wall structures 15, two opposite end wall structures 16, and a bottom structure 17.

In this second embodiment of the steel beam 1 the bottom structure 17 of the fill space housing 14 is formed by the base plate 4 of the steel beam 1.

In this second embodiment of the steel beam 1 one of the opposite end wall structures 16 of the fill space housing 14 is formed by the end plate 7 of the steel beam 1 comprising the first slot 11.

In this second embodiment of the steel beam 1 the other of the opposite end wall structures 16 of the fill space housing 14 is formed by an additional end plate 19 that is provided separated from the end plate 7 of the steel beam 1 comprising the first slot 11 so that the additional end plate 19 extend between the top plate 6 of the steel beam 1, the base plate 4 of the steel beam 1, and the web plates 5 of the steel beam 1.

In this second embodiment of the steel beam 1 the opposite side wall structures 15 of the fill space housing 14 are formed by opposite side plates 20 extending between base plate 4 of the steel beam 1, the additional end plate 19, and the end plate 7 of the steel beam 1 that is provided with the first slot 11.

In this second embodiment of the steel beam 1 the web plates 5 of the steel beam 1 are not directly connected to the end plate 7 of the steel beam 1 comprising the first slot 11, i.e. the web plates 5 of the steel beam 1 do not extend to the end plate 7 of the steel beam 1 comprising the first slot 11.

Figure 12:
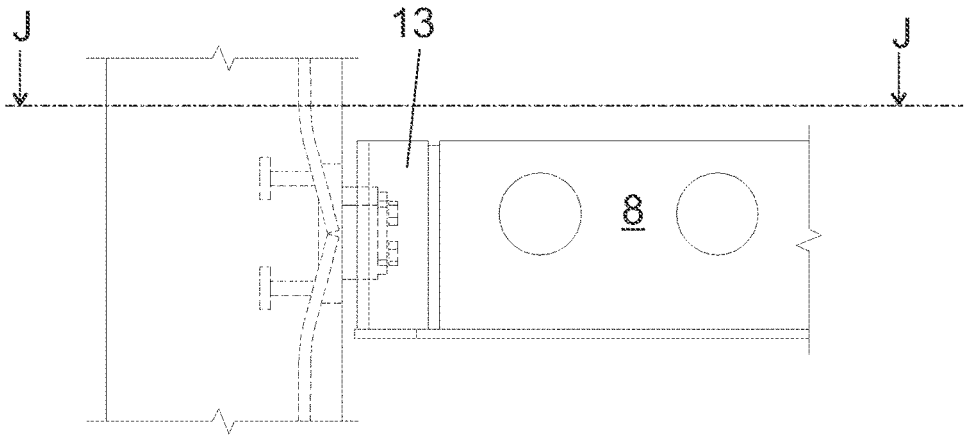
Figure 13:
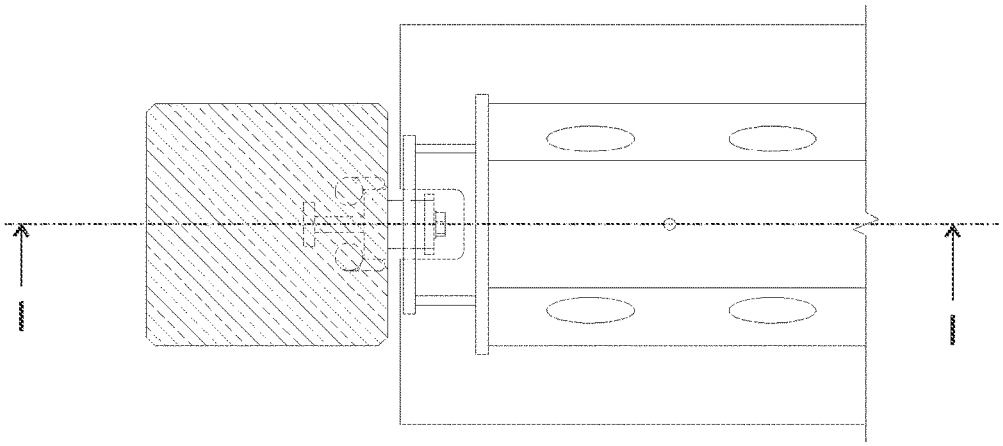

FIGS. 12 and 13 shows supporting of the steel beam 1 according to the second embodiment on a console 2 provided at a column 3. As can be seen in FIGS. 12 and 13, the console 2 extends into the fill space 13 that is by means of the fill space housing 14 separated from the space 8 of the steel beam 1.

Figure 14:
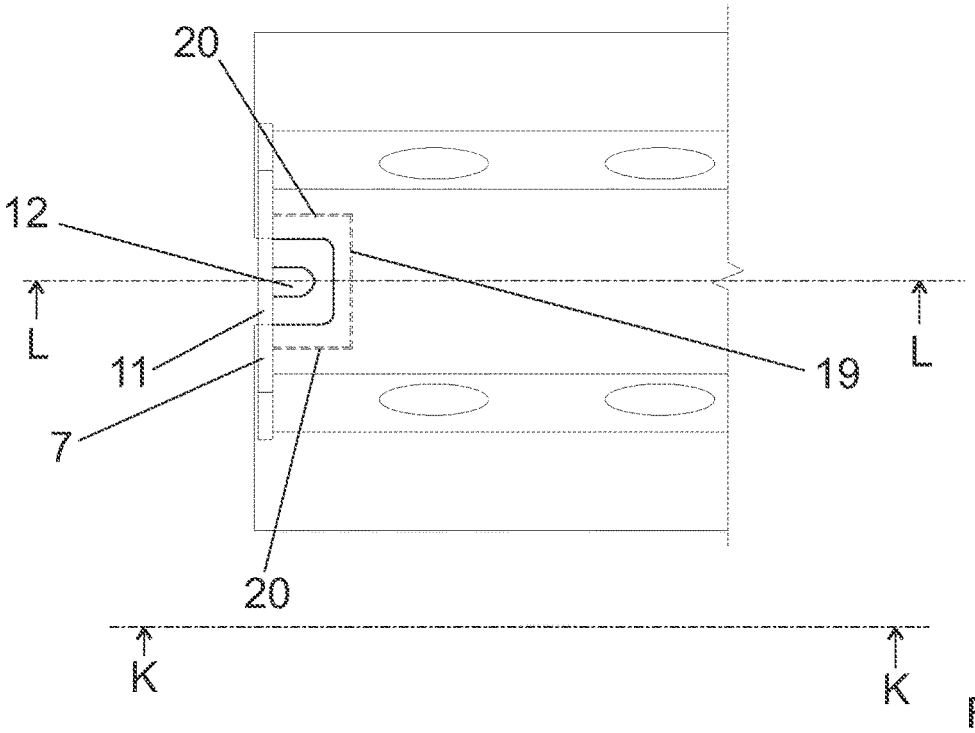
Figure 15:
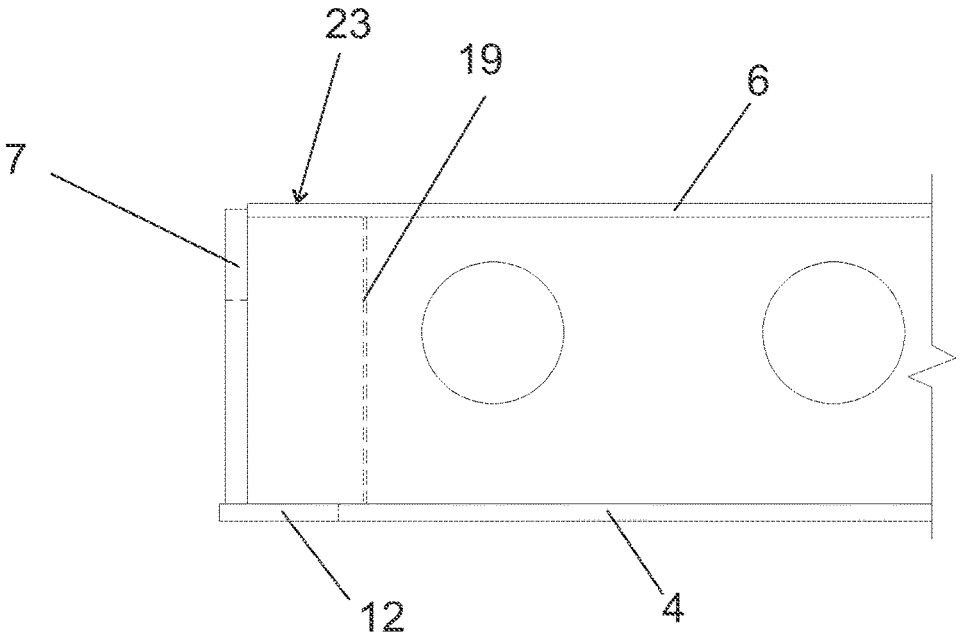
Figure 16:
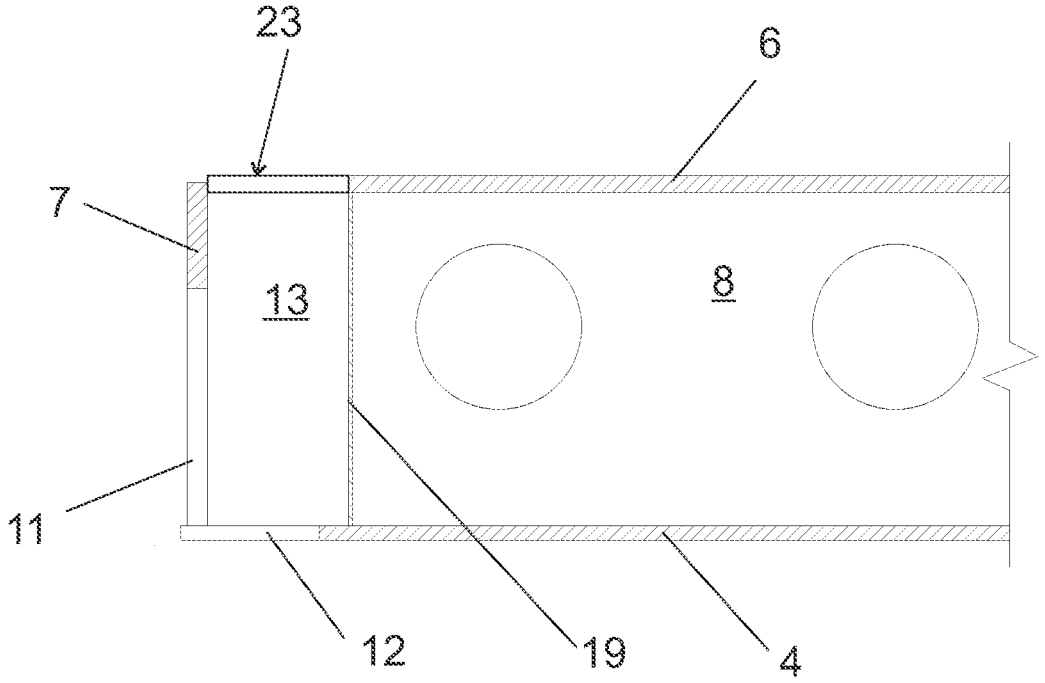

In the third embodiment of the steel beam 1 illustrated in FIGS. 14 to 16, the fill space housing 14 comprises two opposite side wall structures 15, two opposite end wall structures 16, and a bottom structure 17.

In this third embodiment of the steel beam 1 the bottom structure 17 of the fill space housing 14 is formed by the base plate 4 of the steel beam 1.

In this third embodiment of the steel beam 1 one of the opposite end wall structures 16 of the fill space housing 14 is formed by the end plate 7 of the steel beam 1 comprising the first slot 11.

In this third embodiment of the steel beam 1 the web plates 5 of the steel beam 1 are connected to the end plate 7 of the steel beam 1 comprising the first slot 11.

In this third embodiment of the steel beam 1 by the other of the opposite end wall structures 16 of the fill space housing 14 being formed by an additional end plate 19 that is provided separated from the end plate 7 of the steel beam 1 comprising the first slot 11.

In this third embodiment of the steel beam 1 the opposite side wall structures 15 of the fill space housing 14 being formed by two opposite side plates 20 each extending between base plate 4 of the steel beam 1, the additional end plate 19, and the end plate 7 of the steel beam 1 that is provided with the first slot 11.

Because the additional end plate 19 is not connected to the web plates 5 of the steel beam 1 in this third embodiment of the steel beam 1, concrete to be filled i.e. cast into the space 8 of the steel beam 1 can flow between the web plates 5 of the steel beam 1 and the opposite side plates 20 to the end plate 7 of the steel beam 1 comprising the first slot 11. Because concrete is stronger than for example lime mortar, this will have a positive impact on the strength of the steel-concrete-composite beam.

Figure 17:
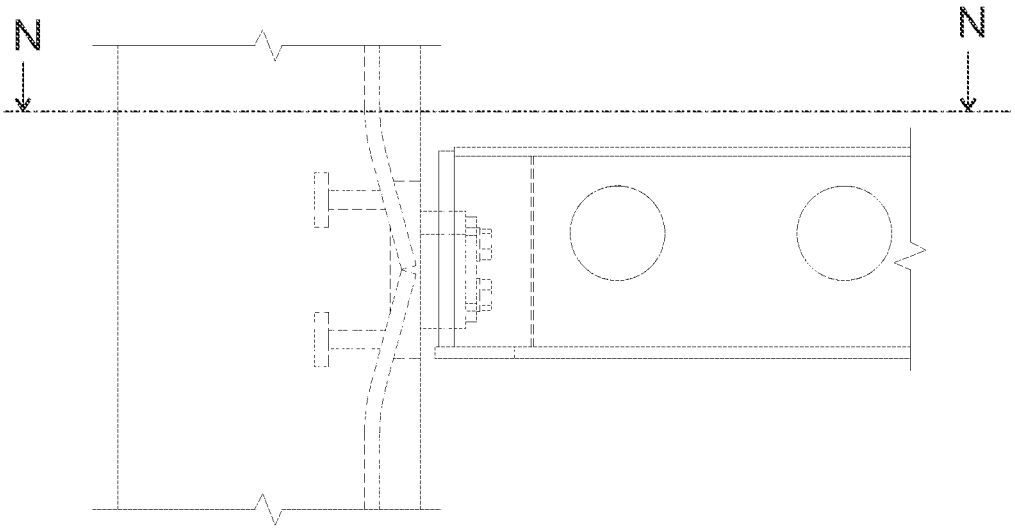
Figure 18:
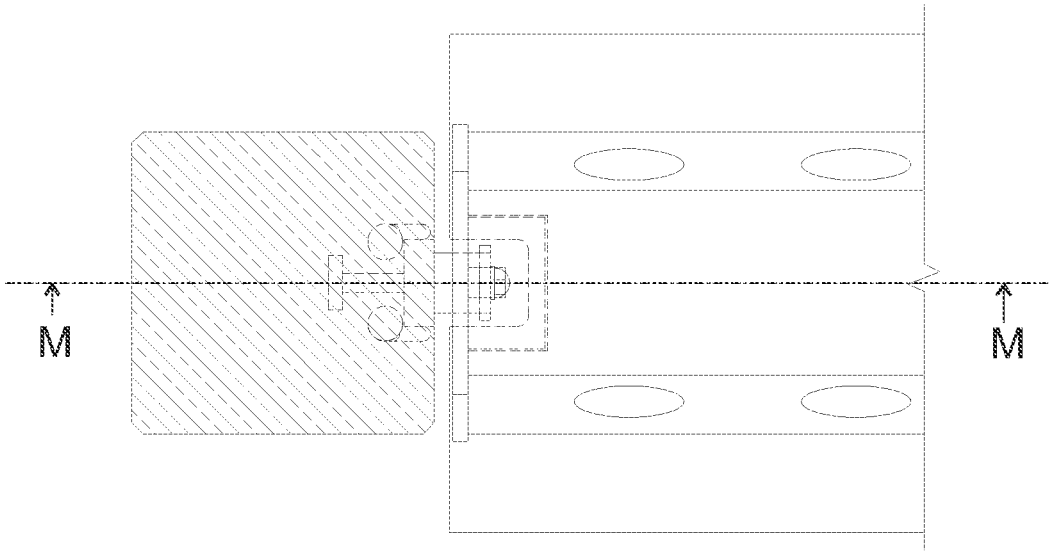
Figure 19:
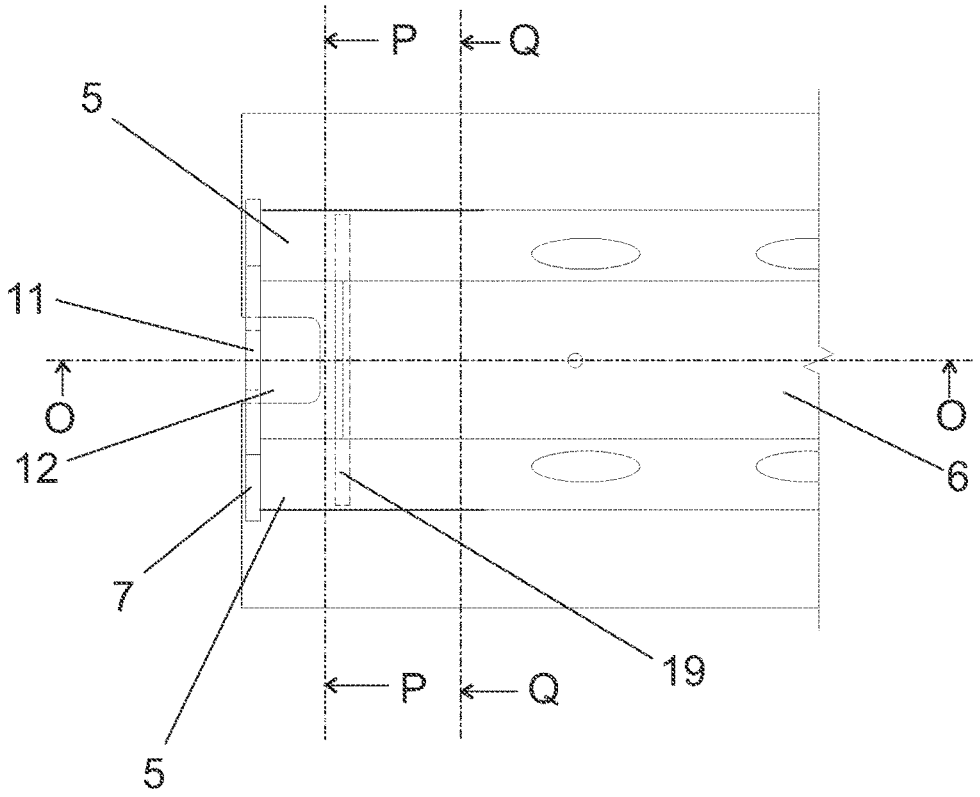
Figure 20:
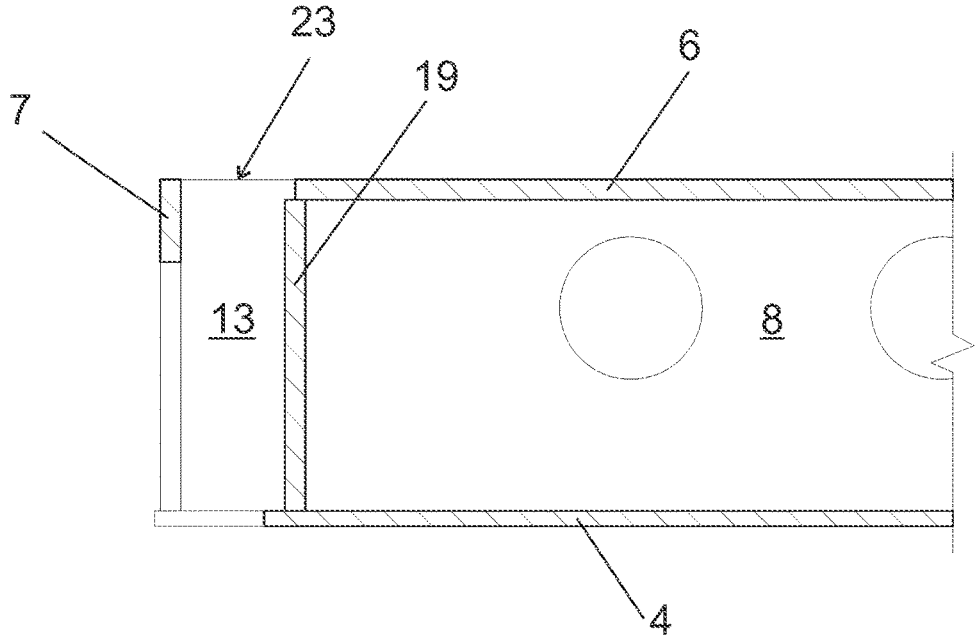
Figure 21:
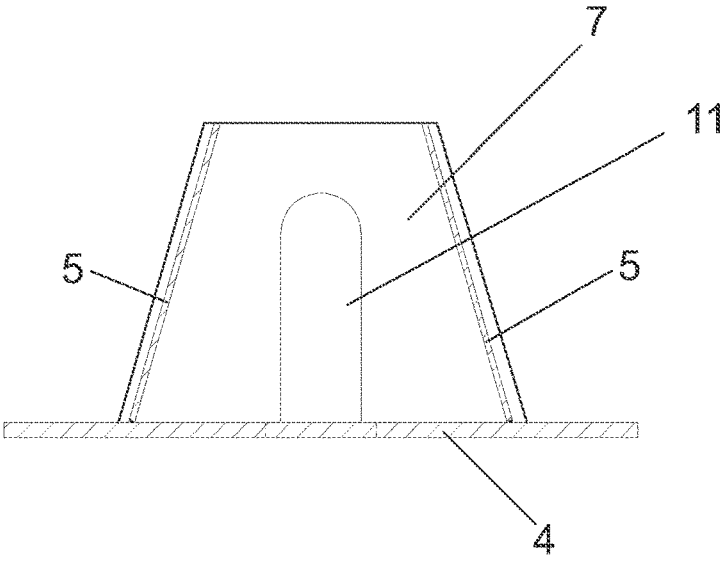
Figure 22:
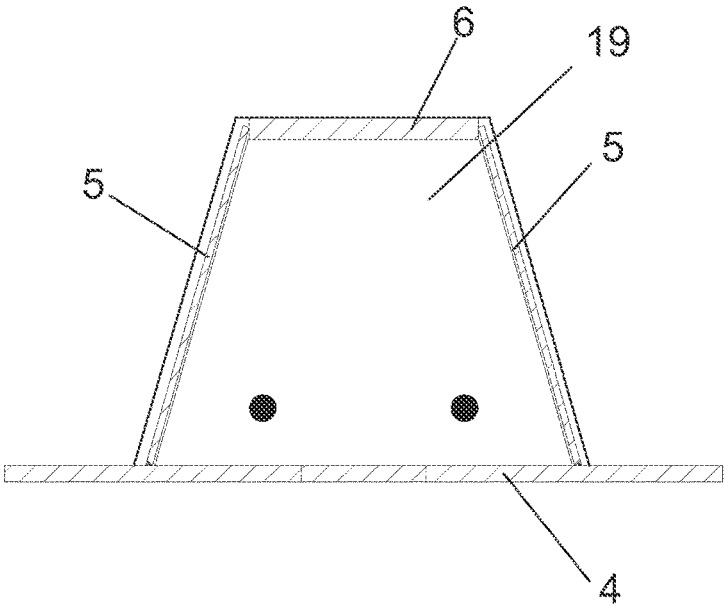

FIGS. 17 and 18 shows supporting of the steel beam 1 according to the third embodiment on a console 2 provided at a column 3. As can be seen in FIGS. 17 and 18, the console 2 extends into the fill space 13 that is by means of the fill space housing 14 separated from the space 8 of the steel beam 1.

In the fourth embodiment of the steel beam 1 illustrated in FIGS. 19 to 22, the fill space housing 14 comprises two opposite side wall structures 15, two opposite end wall structures 16, and a bottom structure 17.

In this fourth embodiment of the steel beam 1 the bottom structure 17 of the fill space housing 14 is formed by the base plate 4 of the steel beam 1.

In this fourth embodiment of the steel beam 1 one of the opposite end wall structures 16 of the fill space housing 14 is formed by the end plate 7 of the steel beam 1 comprising the first slot 11.

In this fourth embodiment of the steel beam 1 the opposite side wall structures 15 of the fill space housing 14 are formed by the web plates 5 of the steel beam 1. In this fourth embodiment of the steel beam 1 the web plates 5 of the steel beam 1 extend to the end plate 7 of the steel beam 1 comprising the first slot 11 and the web plates 5 of the steel beam 1 are connected to the end plate 7 of the steel beam 1 comprising the first slot 11.

In this fourth embodiment of the steel beam 1 the other of the opposite end wall structures 16 of the fill space housing 14 are formed by an additional end plate 19 that is provided separated from the end plate 7 of the steel beam 1 comprising the first slot 11 to extend between the top plate 6 of the steel beam 1, the base plate 4 of the steel beam 1, and the web plates 5 of the steel beam 1.

If the of the other of the opposite end wall structures 16 of the fill space housing 14 is formed by an additional end plate 19 as presented, the additional end plate 19 can be at least partly curved.

Figure 25:
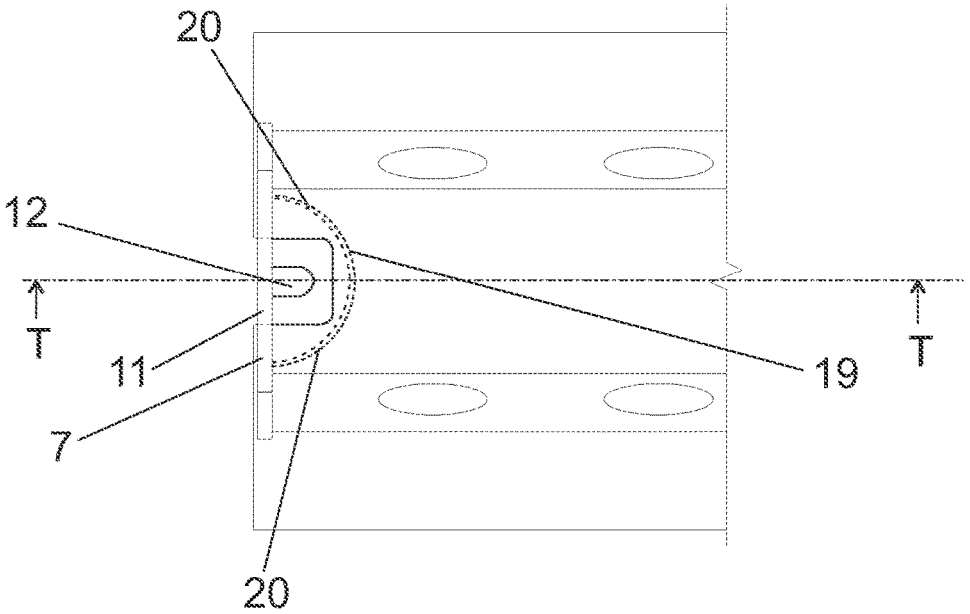
Figure 26:
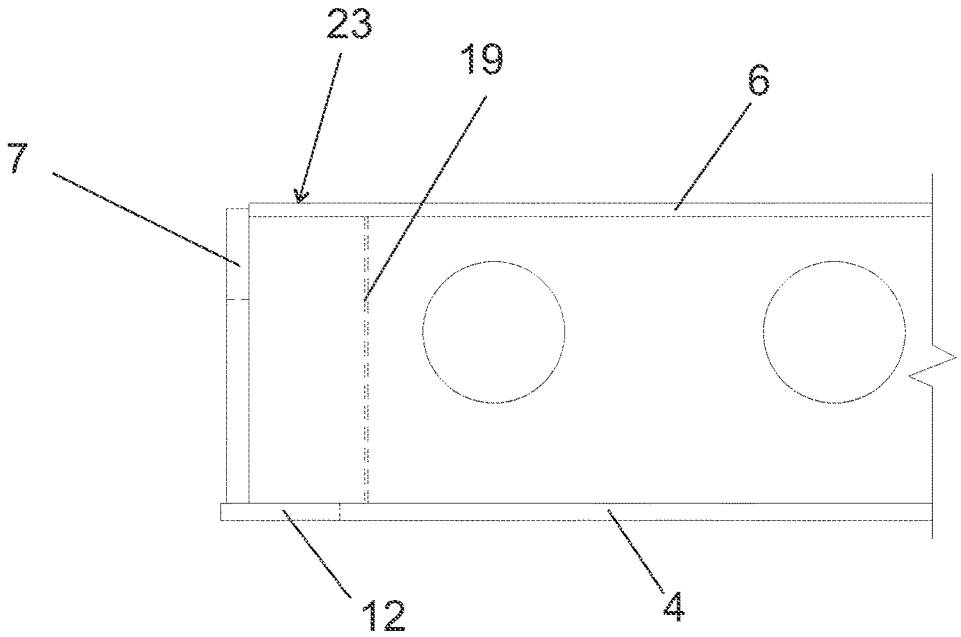
Figure 27:
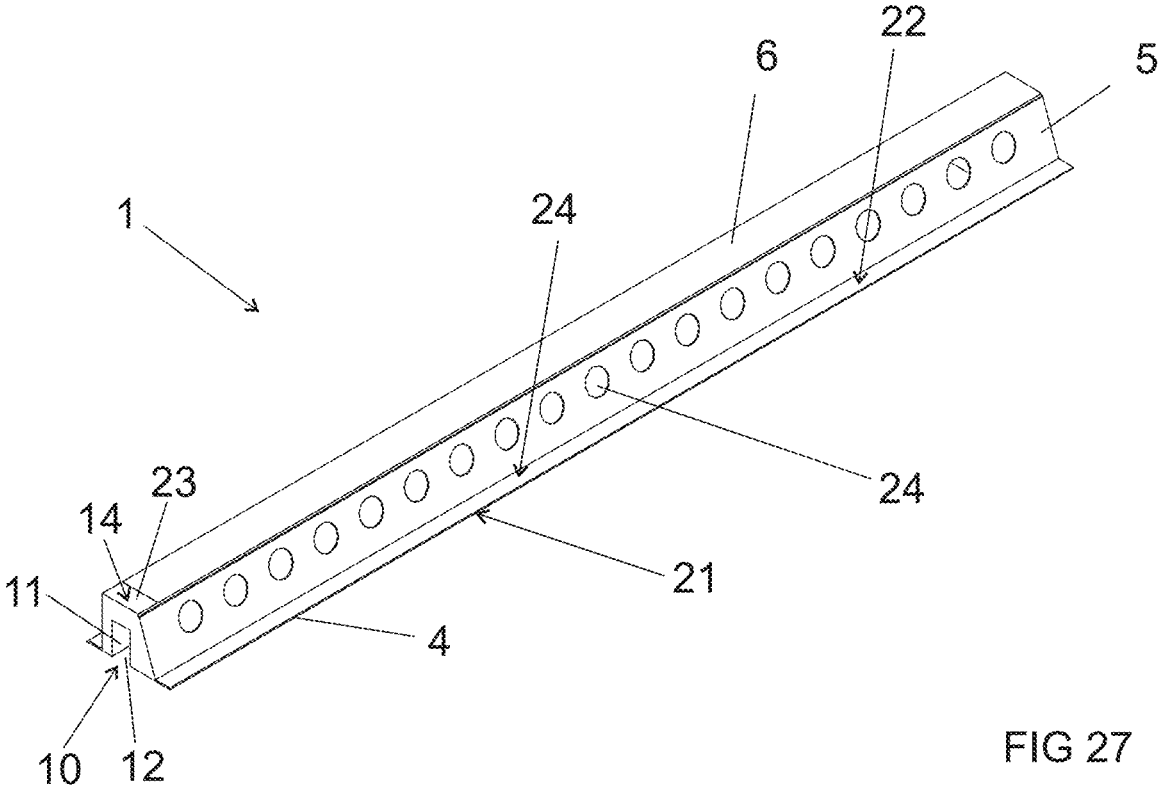
FIG. 27 shows a variant of a steel beam.
Figure 28:
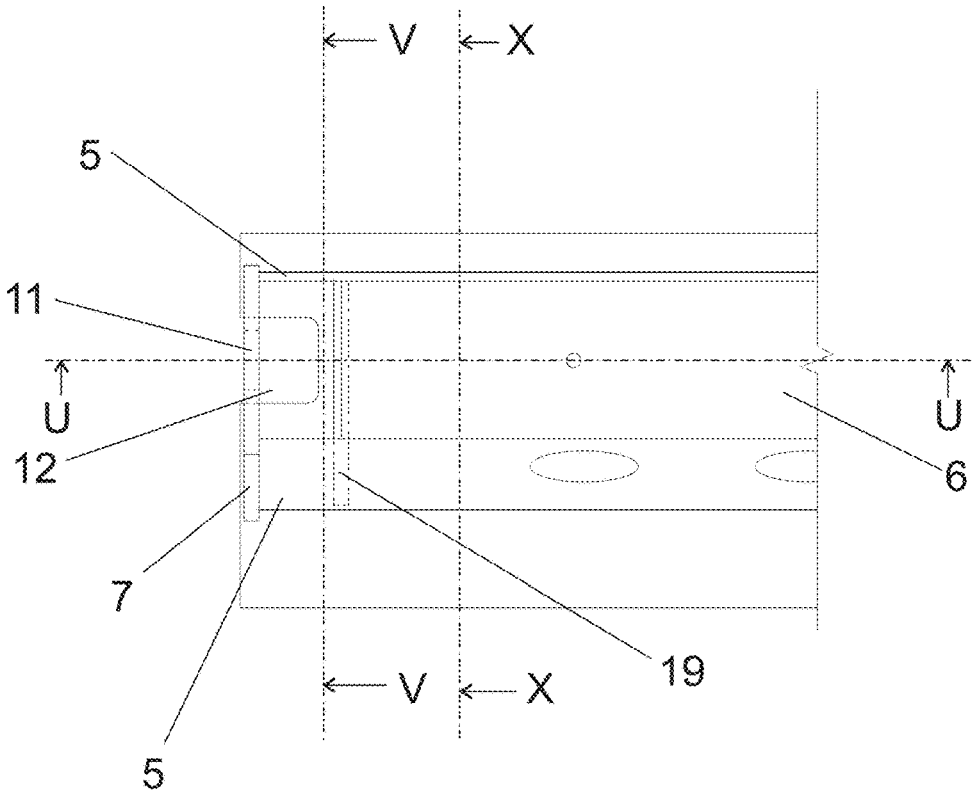
FIG. 28 shows in top view an end of the steel beam of FIG. 27.
Figure 29:
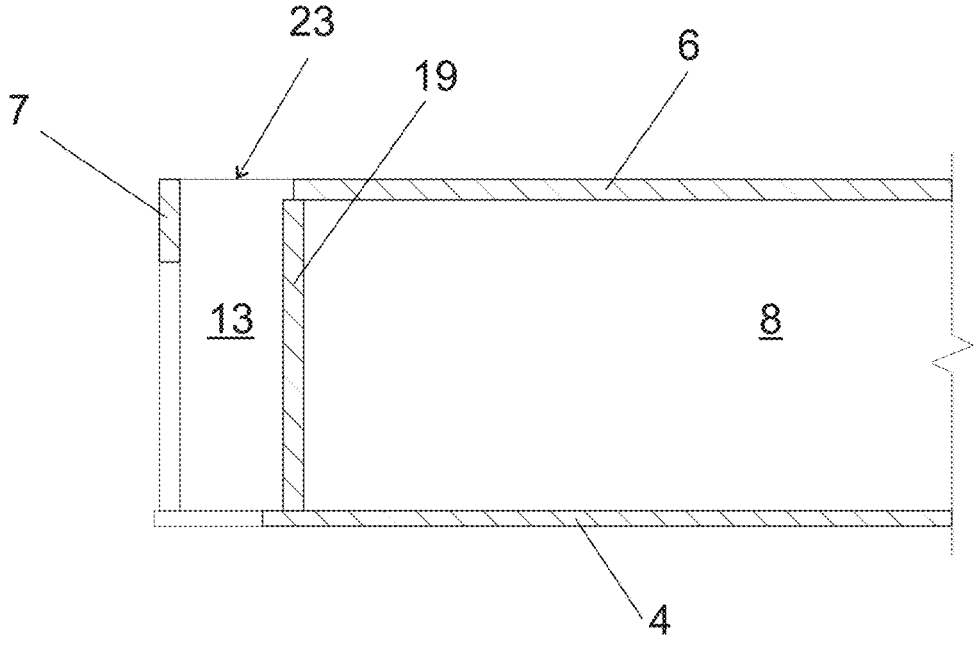
FIG. 29 shows the end of the steel beam according to FIG. 27 as cut along line U-U in FIG. 27.
Figure 30:
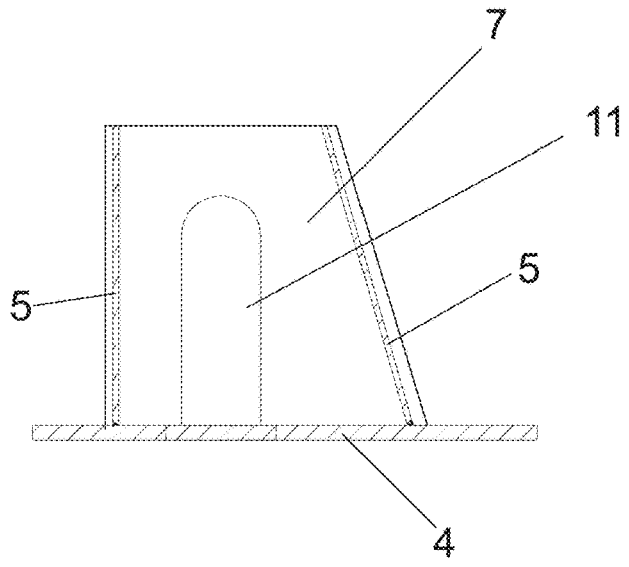
FIG. 30 shows the end of the steel beam according to FIG. 27 as cut along line V-V in FIG. 27.
Figure 31:
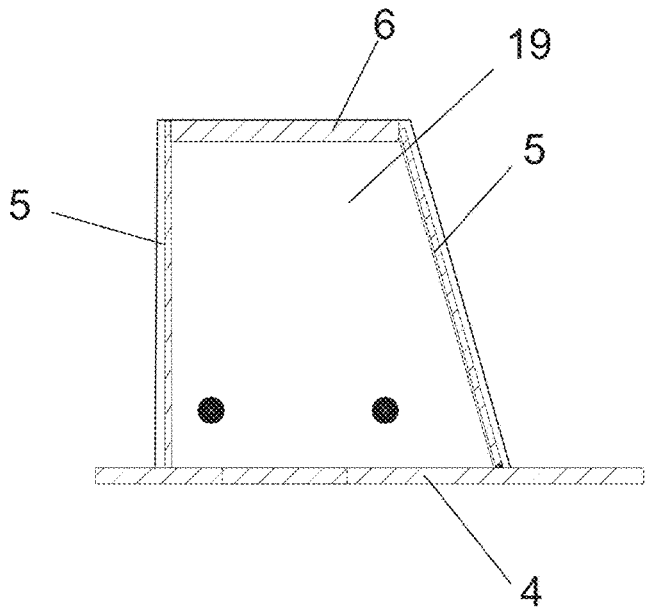
FIG. 31 shows the end of the steel beam according to FIG. 27 as cut along line X-X in FIG. 27.

If the opposite side wall structures of the fill space housing 14 is formed by opposite side plates 20 as presented, the opposite side plates 20 can be at least partly curved If the other of the opposite end wall structures 16 of the fill space housing 14 is formed by an additional end plate 19 as presented and if the opposite side wall structures of the fill space housing 14 is formed by opposite side plates 20 as presented, the additional end plate 19 can be at least partly curved, and the opposite side plates 20 can be at least partly curved, as in the fifth embodiment of the steel beam illustrated in FIGS. 25 and 26. In such embodiments of the steel beam it is for example possible that the fill space housing 14 is at least partly formed by using tube that is cut for example in half or in another way in the lengthwise or longitudinal direction of the tube to provide said additional end plate 19 and said opposite side plates 20 of the fill space housing 14.

Figure 23:
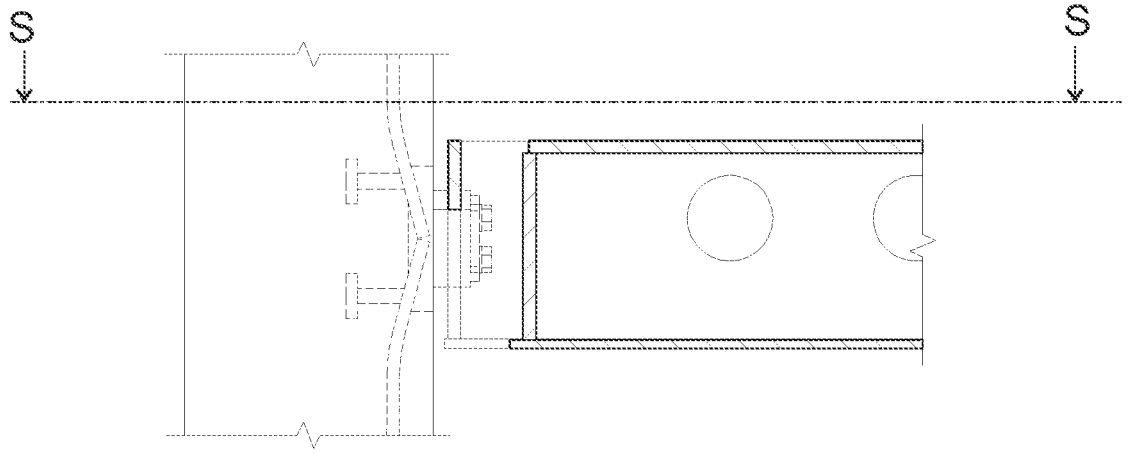
Figure 24:
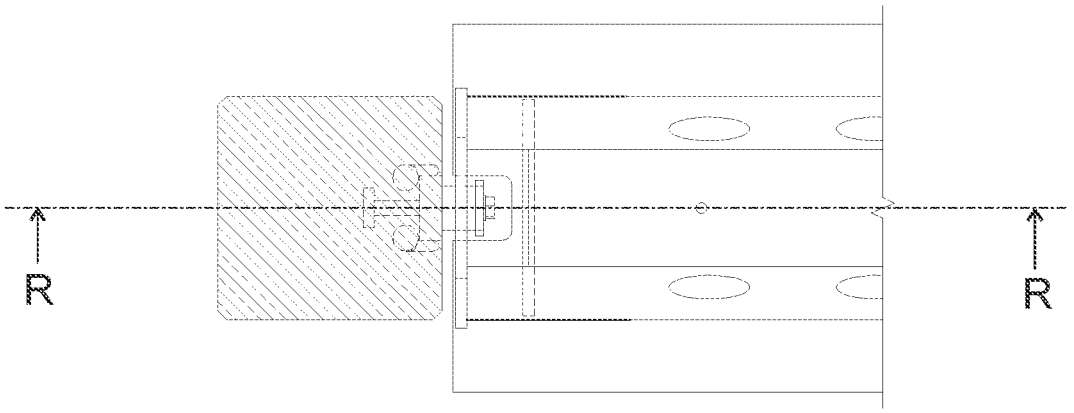

FIGS. 23 and 24 shows supporting of the steel beam 1 according to the fourth embodiment on a console 2 provided at a column 3. As can be seen in FIGS. 23 and 24, the console 2 extends into the fill space 13 that is by means of the fill space housing 14 separated from the space 8 of the steel beam 1.

The two web plates 5 of the steel beam 1 can be inclined in relation to the base plate 4, and by the two web plates 5 of the steel beam 1 being provided with apertures leading into the space 8 of the steel beam 1 for allowing concrete to enter the space 8 of the steel beam 1. Further, as shown in FIGS. 27-31, it is also possible that one of the two web plates 5 of the steel beam 1 extending perpendicularly in relation to the base plate 4 and being essentially free of apertures, and that the other of the two web plates 5 of the steel beam 1 being inclined in relation to the base plate 4 and being provided with apertures. Other configurations of the web plates 5 of the steel beam 1 are also possible.

At least one of the two web plates 5 of the steel beam 1 is preferably, but not necessarily, fastened to the base plate 4 of the steel beam 1 at a distance from an elongated edge 21 of the base plate 4 of the steel beam 1 so that a support flange 22 for at least one building element such a for at least one hollow core slab is formed at the base plate 4 of the steel beam 1 between the elongated edge 21 of the base plate 4 of the steel beam 1 and said at least one of the two web plates 5 of the steel beam 1.

The possible top plate 6 of the steel beam 1 forms preferably, but not necessarily, in some variants of the steel beam 1, part of the fill space housing 14. In such variants of the steel beam 1, the fill opening 23 of the fill space housing 14 is preferably, but not necessarily, provided at least partly between the top plate 6 of the steel beam 1 and the end plate 7 of the steel beam 1. In such variants of the steel beam 1, the fill opening 23 of the fill space housing 14 can alternatively preferably, but not necessarily, be provided at least partly in the top plate 6 of the steel beam 1.

It is apparent to a person skilled in the art that as technology advances, the basic idea of the invention can be implemented in various ways. The invention and its embodiments are therefore not restricted to the above examples, but they may vary within the scope of the claims.

The invention claimed is:

1. A steel beam comprising a base plate, two web plates extending from the base plate, and an end plate of each end of the steel beam, wherein:

the base plate, the two web plates, and the end plates delimit a space configured to be filled at least partly with hardening material, and at least one of the ends of the steel beam comprising a console supporting slot extending from said at least one end of the steel beam, wherein the console supporting slot forms a first slot in the end plate of the steel beam and a second slot in the base plate of the steel beam, the steel beam comprises a fill space at at least one of the ends of the steel beam, the fill space is limited by a fill space housing configured to separate the fill space from the space of the steel beam, the console supporting slot is provided at least partly in the fill space so that the console supporting slot being separated from the space of the steel beam by the fill space housing, and the fill space housing has, in addition to the console supporting slot, a fill opening leading into the fill space.

2. The steel beam according to claim 1, wherein the fill space housing comprises at least two opposite side wall structures, at least two opposite end wall structures, and a bottom structure.

3. The steel beam according to claim 2, wherein the bottom structure of the fill space housing is formed by the base plate of the steel beam.

4. The steel beam according to claim 2, wherein one of the opposite end wall structures of the fill space housing is formed by the end plate of the steel beam comprising the first slot.

5. The steel beam according to claim 4, wherein:

the opposite side wall structures of the fill space housing are formed by additional web plates, each additional web plate extends between one of the web plates of the steel beam and the end plate of the steel beam that is provided with the first slot, the other of the opposite end wall structures of the fill space housing is formed by an additional end plate that is provided separated from the end plate of the steel beam comprising the first slot, and the additional end plate extends between the base plate of the steel beam, and the web plates of the steel beam.

6. The steel beam according to claim 4, wherein:

the opposite side wall structures of the fill space housing are formed by the web plates of the steel beams, the web plates of the steel beam are connected to the end plate of the steel beam comprising the first slot, the other of the opposite end wall structures of the fill space housing is formed by an additional end plate that is provided separated from the end plate of the steel beam comprising the first slot, and the additional end plate extends between the base plate of the steel beam, and the web plates of the steel beam.

7. The steel beam according to claim 4, wherein:

the other of the opposite end wall structures of the fill space housing is formed by an additional end plate that is provided separated from the end plate of the steel beam comprising the first slot, the additional end plate extends between the base plate of the steel beam, and the web plates of the steel beam, and the opposite side wall structures of the fill space housing are formed by opposite side plates extending between base plate of the steel beam, the additional end plate, and the end plate of the steel beam that is provided with the first slot.

8. The steel beam according to claim 4, wherein:

the web plates of the steel beam are connected to the end plate of the steel beam comprising the first slot, the other of the opposite end wall structures of the fill space housing is formed by an additional end plate that is provided separated from the end plate of the steel beam comprising the first slot, and the opposite side wall structures of the fill space housing are formed by opposite side plates extending between base plate of the steel beam, the additional end plate, and the end plate of the steel beam that is provided with the first slot.

9. The steel beam according to claim 5, wherein the additional end plate is at least partly curved.

10. The steel beam according to claim 7, wherein the opposite side plates are at least partly curved.

11. The steel beam according to claim 7, wherein the additional end plate is at least partly curved, and by the opposite side plates are at least partly curved.

12. The steel beam according to claim 1, wherein:

the two web plates of the steel beam are inclined in relation to the base plate, and the two web plates of the steel beam are provided with apertures.

13. The steel beam according to claim 1, wherein:

one of the two web plates of the steel beam extends perpendicularly in relation to the base plate and being free of apertures, and the other of the two web plates of the steel beam is inclined in relation to the base plate and being provided with apertures.

14. The steel beam according to claim 1, wherein at least one of the two web plates of the steel beam is fastened to the base plate of the steel beam at a distance from an elongated edge of the base plate of the steel beam so that a support flange is formed at the base plate of the steel beam between the elongated edge of the base plate of the steel beam and the at least one of the two web plates of the steel beam.

15. The steel beam according to claim 1, further comprising:

a top plate connecting the two web plates, wherein the top plate at least partly limits the space of the steel beam.

16. The steel beam according to claim 15, wherein the top plate of the steel beam forms a part of the fill space housing.

17. The steel beam according claim 16, wherein the fill opening of the fill space housing is provided at least partly between the top plate of the steel beam and the end plate of the steel beam.

18. The steel beam according to claim 15, wherein the fill opening of the fill space housing is provided at least partly in the top plate of the steel beam.

19. The steel beam according to claim 1, wherein the hardening material is concrete.

20. The steel beam according to claim 1, wherein the fill space housing has air outlet openings leading out of the fill space.

* * * * *